US006715226B1

(12) United States Patent
Sikanovski

(10) Patent No.: US 6,715,226 B1
(45) Date of Patent: Apr. 6, 2004

(54) COMBINED HOLDER AND DISPLAY ASSEMBLY FOR BABY BIBS

(76) Inventor: Draga Sikanovski, 39039 Juniper Tree Rd., Palmdale, CA (US) 93551-3835

( * ) Notice: Subject to any disclaimer, the term of this patent is extended or adjusted under 35 U.S.C. 154(b) by 115 days.

(21) Appl. No.: 10/196,489

(22) Filed: Jul. 16, 2002

Related U.S. Application Data

(63) Continuation-in-part of application No. 29/122,536, filed on Apr. 27, 2000.

(51) Int. Cl.[7] ..... A47G 1/06
(52) U.S. Cl. ..... 40/776; 40/722; 40/800
(58) Field of Search ..... 40/800, FOR 160, 40/777, 776, 722, 654.01, 124.06, 661, 765

(56) References Cited

U.S. PATENT DOCUMENTS 3,555,713 A * 1/1971 Leinbach ..... 40/776 X
4,016,664 A * 4/1977 Kaufmann ..... 40/776 X
5,119,574 A * 6/1992 King ..... 40/776 X
5,713,146 A * 2/1998 Reeves, Sr. ..... 40/722 X
6,101,752 A * 8/2000 Cumberland ..... 40/777 X
6,282,826 B1 * 9/2001 Richards ..... 40/776 X

* cited by examiner

*Primary Examiner*—Joanne Silbermann
(74) *Attorney, Agent, or Firm*—Gary Schnittgrund; Law Offices of Gary Schnittgrund

(57) ABSTRACT

The invention is a device that enables a child's baby bib to be preserved and displayed along with other memorabilia in a permanent holder. The baby bib is mounted on a frame backing sheet by slits. The sheet is attached to a frame that allows for a removable placement of a display board, which may contain photographs and other memorabilia. The entire combined holder and display is readily mountable in a book or album.

8 Claims, 3 Drawing Sheets

COMBINED HOLDER AND DISPLAY ASSEMBLY FOR BABY BIBS

CROSS REFERENCE TO RELATED APPLICATION

This application is a continuation in part of co-pending application Ser. No. 29/122,536 entitled "A COMBINED HOLDER AND DISPLAY ASSEMBLY FOR BABY BIBS," filed Apr. 27, 2000.

FIELD OF THE INVENTION

This invention relates to a device and methods of preserving and displaying baby bibs for viewing.

BACKGROUND OF THE INVENTION

Proud parents have long attempted to preserve memorabilia of their child's infancy. Parents save bronzed baby shoes, photographs, baby hair, baby teeth, baby clothes, toys, dolls, drawings, writings, audiotapes, films, and videotapes, which document and commemorate their child's early years. However, attempts to preserve and display baby bibs have largely been unsuccessful since the baby bibs are very small, fragile, and generally difficult to present to a viewer. Baby's first food stains are difficult to preserve, since they will eventually fall from the baby bib as the bib is abused in its normal storage location with all of baby's other clothing and toys. There is a need to provide a method of preserving and displaying baby's first bib, which can present an enduring reminder of the first of baby's meals.

SUMMARY OF THE INVENTION

The apparatus of the instant invention is a device to enable a baby bib to be preserved, mounted and displayed for easy viewing. The baby bib holder contains frame backing sheets for attaching baby bibs by means of slits, where the baby bib is drawn thorough the slits and tied in place. A piece of clear plastic may be placed over the baby bib to protect it from damage and to enable it to be readily viewed. A display board that may contain photographs, artwork, and other mementos may also be mounted in a frame that contains both the baby bib and the other mementos of the baby's life. Both the baby bib and the display may be protected from degradation and handling by plastic covers which are retained in the frame. The baby bib holder contains a book connection that allows it to be mounted in a display book or album.

The novel features of the invention are set forth with particularity in the appended claims. The invention will be best understood from the following description when read in conjunction with the accompanying drawings.

OBJECTS OF THE INVENTION

It is an object of the invention to provide a display for a baby bib.

It is an object of the invention to provide a method for a parent to save a baby bib in a preserved manner for display with other childhood memorabilia.

It is an object of the invention to provide a method of displaying a baby bib.

Other objects, advantages and novel features of the present invention will become apparent from the following detailed description of the invention when considered in conjunction with the accompanying drawing.

DETAILED DESCRIPTION OF THE PREFERRED EMBODIMENT

Figure 1:
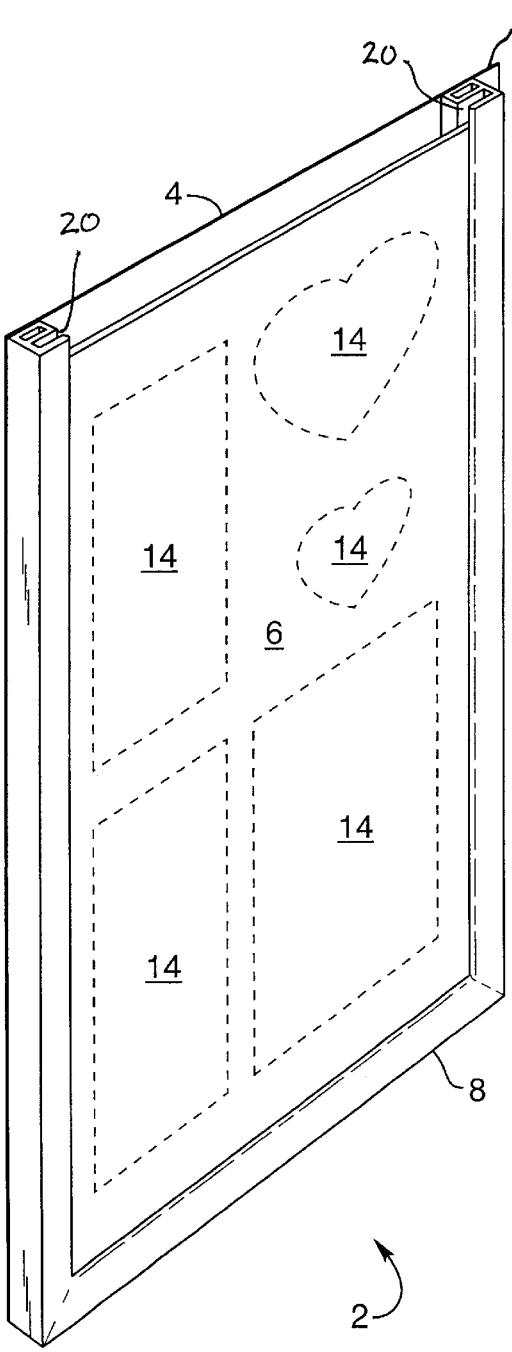
FIG. 1 is a back perspective view of a combined holder and display assembly for baby bibs.

FIG. 1 provides a back perspective view of a preferred embodiment of the baby bib holder and display assembly, generally 2. The baby bib holder 2 is comprised of one or more frame backing sheets 4, one for each baby bib that is to be displayed. In a preferred embodiment, only one frame backing sheet 4 is presented in FIG. 1, although it is obvious that more than one sheet 4 can be mounted in a bib holder and display assembly 2.

Photographs 14 or other memorabilia, such as artwork and drawings, may be mounted on display board 6, which is placed in frame 8 along with frame backing sheet 4. Frame 8 preferably has a rectangular cross-sectional, thereby creating a thickness that creates spacer section between display boards, with at least one slot therein for mounting the display. Frame 8 contains frame slots 20 into which display board 6 is slideably fitted. The slot section 20 is spaced away from the back for holding a clear plastic cover on the frame, the slot 20 having side and bottom engagement with the frame to accept display board 6. Frame 8 also creates a spacer section for providing a space for the baby bib tie to be secured between frame backing sheet 4 and display board 6. Further, in a preferred embodiment the thickness of frame 8 creates a spaced section from the display board 6 for mounting a clear plastic front cover on frame 8.

In a preferred embodiment, one leg of frame 8 is removably connected to facilitate placement of the display board 6 into frame 8. It is preferred that frame backing sheet 4 be permanently attached to frame 8 by a means such as glue or tacks, although alternate embodiments allow the frame backing sheet 4 to be removably inserted into frame 8. The frame may be made of any known framing material, such as wood or plastic. In a preferred embodiment, clear plastic frame backing sheets, not illustrated, are placed over the mounted baby bib 12 and photographs 14 to preserve and protect them damage that might be incurred during handling and storage. The clear plastic enables easy viewing of the displayed items. A further alternative embodiment has more than one baby bib holder 2 held together with hinges (not illustrated) that are mounted on frame 8.

Figure 2:
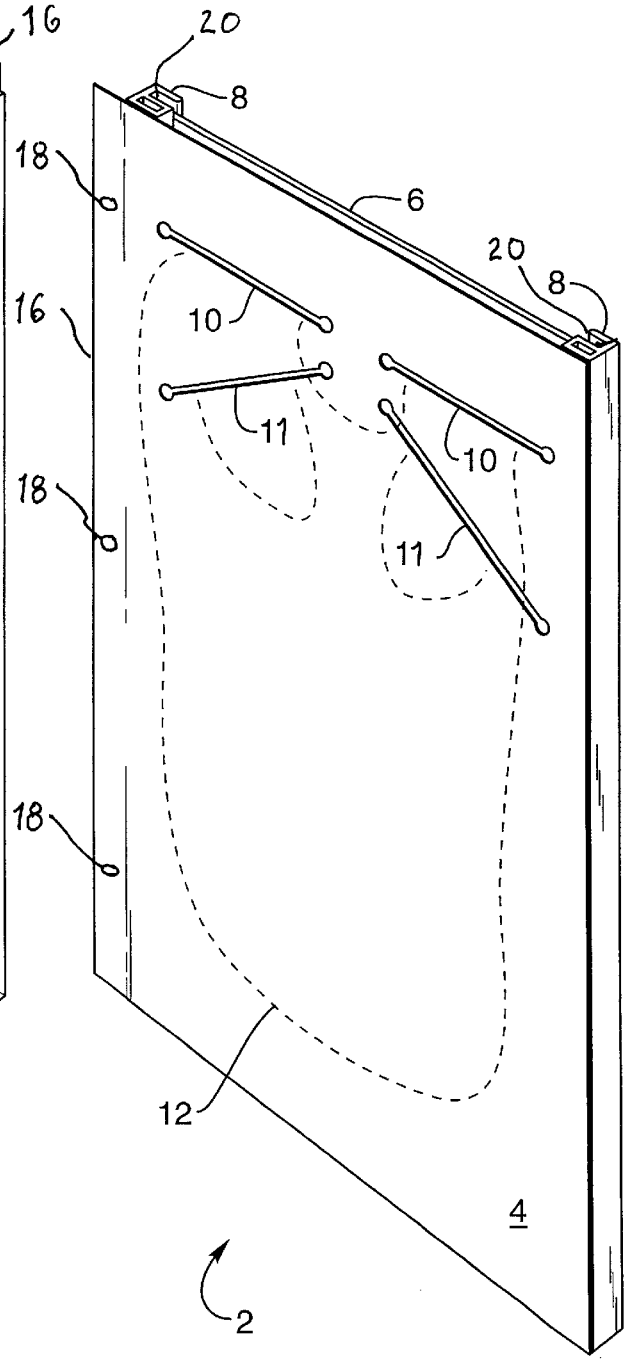
FIG. 2 is a perspective view of the front of a combined holder and display assembly for baby bibs.

FIG. 2 is a perspective view of the front of a combined holder and display assembly for baby bibs 12. The baby bib holder 2 is comprised of one or more frame backing sheets 4, one for each baby bib, which hold the baby bib 12 in place by means of horizontal slits 10 and diagonal slits 11 that pass through frame backing sheet 4 and which are aligned with the baby bib ties [not illustrated] to allow the ties to pass through frame backing sheet 4 and to retain the baby bib 12 in position on frame backing sheet 4. The baby bib 12 may be further attached to frame backing sheet 4 by placing tape, glue, or Velcro between the baby bib 12 and sheet 4.

Frame backing sheet 4 contains a book connection 16 that is a flap which allows the baby bib holder 2 to be mounted for display, for example in a book by attaching to a book binding or in an album. In a preferred embodiment book connection 16 contains mounting holes 18 for placement in a ring binder, although alternative embodiments may use other known mounting techniques to retain the holder 2 in a display device, such as a book.

Figure 3:
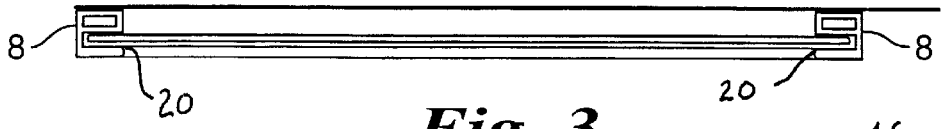
FIG. 3 is a top view of the front of a combined holder and display assembly for baby bibs.

FIG. 3 is a top view of the front of a combined holder and display assembly for baby bibs showing the top rail of frame 8 and frame slots 20, which retain display board 6.

Figure 4:
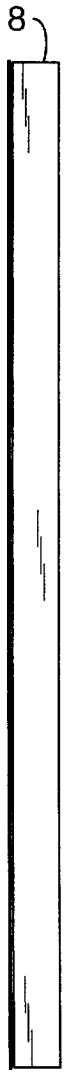
FIG. 4 is a left side view of the front of a combined holder and display assembly for baby bibs.

FIG. 4 is a left side view of the front of a combined holder and display assembly for baby bibs 2 showing a left side rail of frame 8.

Figure 5:
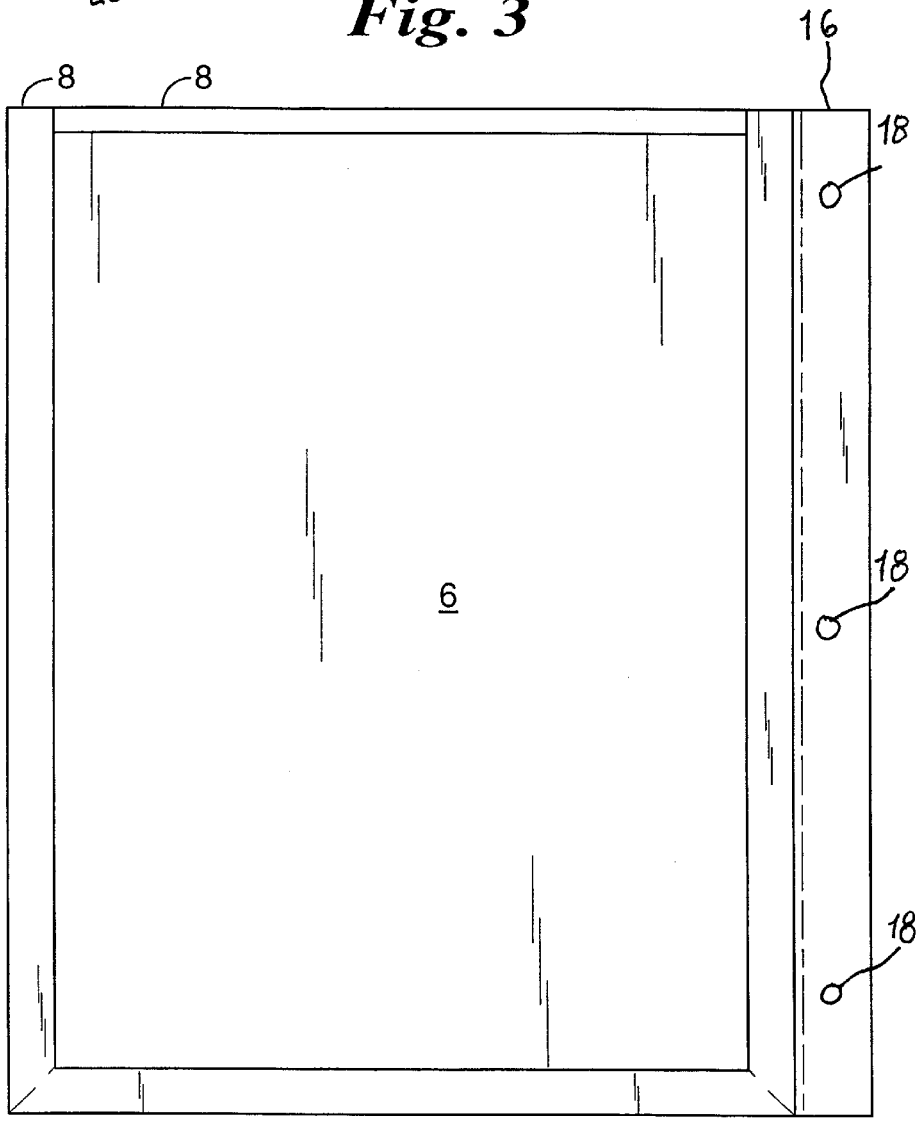
FIG. 5 is a back view of the front of a combined holder and display assembly for baby bibs.

FIG. 5 is a back view of the combined holder and display assembly for baby bibs 2 showing the back of display board 6. Book connection 16 is also shown with preferred embodiment mounting holes 18.

Figure 6:
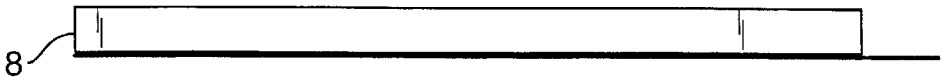
FIG. 6 is a bottom view of the front of a combined holder and display assembly for baby bibs.

FIG. 6 is a bottom view of the front of a combined holder and display assembly for baby bibs 2 showing the bottom rail of frame 8.

Figure 7:
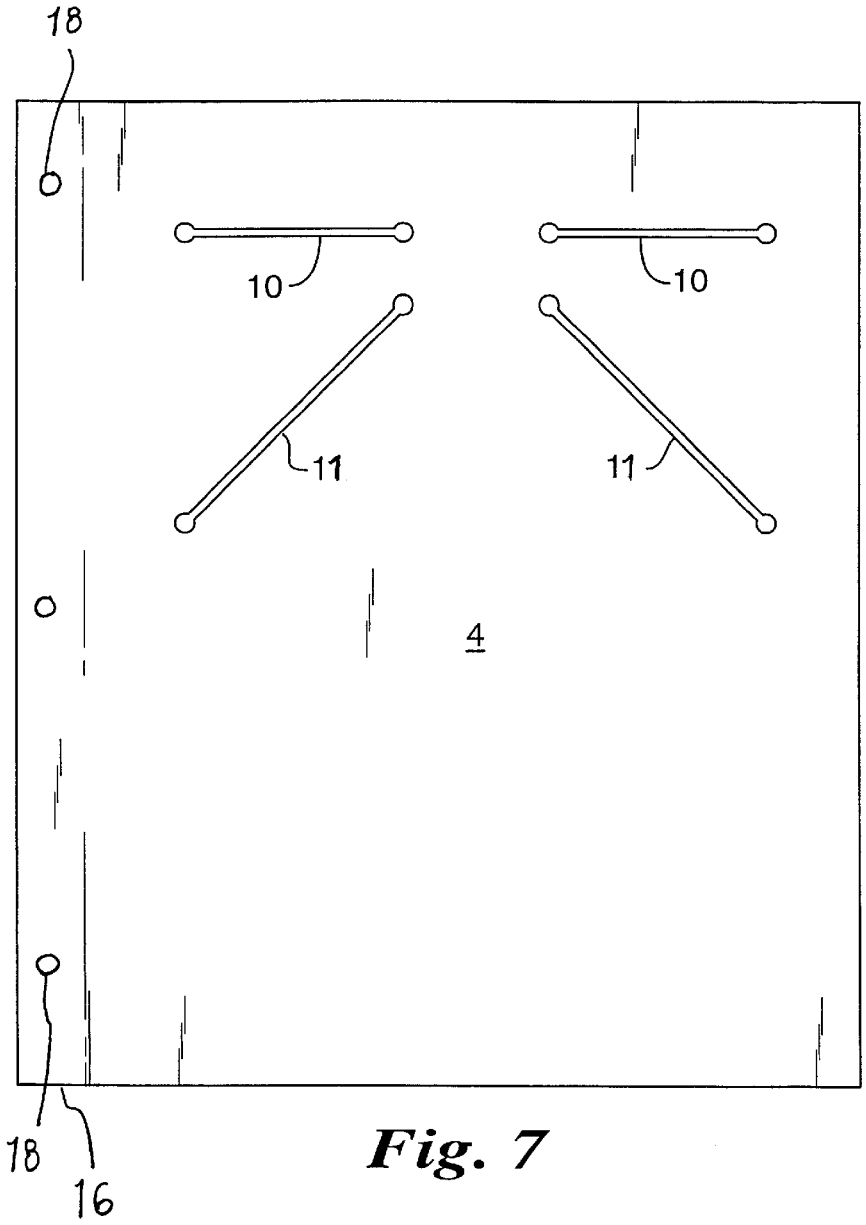
FIG. 7 is a front view of the front of a combined holder and display assembly for baby bibs.

FIG. 7 is a front view of the front of a combined holder and display assembly for baby bibs 2 showing the oriented horizontal slits 10 and diagonal slits 11, in frame backing sheet 4, that will preferably accept the baby bib ties [not illustrated] to retain the baby bib 12 in position for display. Book connection 16 and mounting holes 18 are also presented.

Figure 8:
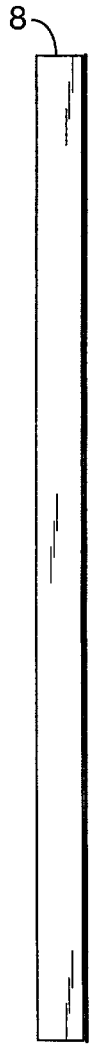
FIG. 8 is a right side view of the front of a combined holder and display assembly for baby bibs.

FIG. 8 is a right side view of the front of a combined holder and display assembly for baby bibs 2 showing a right side rail of frame 8.

Obviously, many modifications and variations of the present invention are possible in light of the above teachings. It is therefore to be understood that, within the scope of the appended claims, the invention may be practiced otherwise than as specifically described.

What is claimed is:

1. A baby bib display comprising:

a frame having a frame backing sheet with at least one horizontal slit and at least one diagonal slit adjacent each horizontal slit, the slits for receiving a baby bib tie;

the frame backing sheet having a book engaging edge extending beyond the frame for attachment to a book binding;

the frame having a spacer section for providing a space for the baby bib to be attached to the frame backing sheet;

a transparent cover;

a slot section spaced from the back for holding a display board; and a slot having top, side and bottom engagement with the frame.

2. The baby bib display according to claim 1 further comprising a method of connecting said frame to a display book.

3. The baby bib display according to claim 1 wherein said frame is comprised of plastic.

4. The baby bib display according to claim 1 wherein said frame is comprised of wood.

5. The baby bib display according to claim 1 further comprising slits directly in alignment with said baby bib ties.

6. A baby bib display device comprising:

a slotted rectangular frame;

a frame slot in said frame;

a frame backing sheet;

at least one horizontal slit and at least one diagonal slit for mounting said baby bib to said frame backing sheet;

a spacer section for providing a space for the baby bib to be attached to the frame backing sheet;

a book connection having apertures for mounting the baby bib display device in a book;

a display board that is slideably mounted in said frame slot; and a transparent cover that is slideably mounted over said display board.

7. A method of displaying baby bibs comprising the steps of:

providing a frame backing sheet having a horizontal slit and at least one diagonal slit;

inserting bib ties in said horizontal slit and said at least one diagonal slit;

providing frame with width having slots spaced from back;

placing frame backing sheet on said frame;

sliding display board in slots to place baby bib tie between back and cover;

providing book connection with apertures in a portion extending beyond the frame for inserting in the book; and placing top of frame on frame to seal in the display board.

8. The method of claim 7 further comprising placing a transparent plastic cover in said frame.

* * * * *